US006445890B2

(12) United States Patent
Ishii

(10) Patent No.: US 6,445,890 B2
(45) Date of Patent: Sep. 3, 2002

(54) IMAGE FORMING APPARATUS

(75) Inventor: Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/903,673

(22) Filed: Jul. 13, 2001

(30) Foreign Application Priority Data

Jul. 14, 2000 (JP) ..... 2000-214853

(51) Int. Cl.[7] ..... G03G 15/16

(52) U.S. Cl. ..... 399/66; 399/296; 399/310; 399/313

(58) Field of Search ..... 399/66, 310, 313, 399/314, 296

(56) References Cited

U.S. PATENT DOCUMENTS 5,563,693 A * 10/1996 Takahata et al. ..... 399/310
5,909,605 A * 6/1999 Nishizawa et al. ..... 399/66

FOREIGN PATENT DOCUMENTS

JP 2000-75690 3/2000

* cited by examiner

*Primary Examiner*—William J. Royer

(57) ABSTRACT

In cases where equivalent air thicknesses topc ($\mu$m) and yt ($\mu$m) of the photosensitive layer and toner layer, respectively, an amount of charge per unit area (qpm (mg/cm$^2$)$^{-1}$) of the toner layer, normalized based on an amount of charge per unit area ρopc in a non-image portion of the photosensitive layer, an amount of charge per unit area ρ'opc in the non-image portion of the photosensitive layer upon entrance into a transfer region, and a total amount of charge per unit area ρo of the toner layer are set so as to satisfy the following equation, then, variance of electric field hardly occurs in the transfer region:

$$|(\rho'opc-\rho o)/(\rho opc-\rho o)|<1$$

where $$\rho o=qpm\{(-0.01\cdot topc+0.145)yt^2+(0.001\cdot topc+0.937)yt\}.$$

16 Claims, 14 Drawing Sheets

IMAGE FORMING APPARATUS

BACKGROUND OF THE INVENTION

1. Field of the Invention

The present invention relates to an image forming apparatus, such as a copying machine and a printer, for performing electrophotographic image forming processing by forming an electrostatic latent image on the surface of an image carrier, and transferring a toner image electrostatically adhering to the electrostatic latent image onto a transfer material.

2. Description of the Related Art

An image forming apparatus performing electrophotographic image forming processing has been adapted to meet the demands of high resolution products in recent years by reducing the layer thickness of the photosensitive layer covering the surface of the image carrier to as thin as 10 to 20 $\mu$m. With the image carrier covered by the photosensitive layer with a thinner film thickness, a potential is smoothed in each of a light portion and a dark portion, thereby making it possible to form an electrostatic latent image with a well-defined edge portion. As a result, when the electrostatic latent image is developed into a visible image, a sharp toner image can be obtained.

However, when the toner image developed as the visible image from the electrostatic latent image with the well-defined edge portion is transferred onto a transfer material, a part of toner forming the toner image is scattered over the image carrier, which results in a problem that the image quality on the transfer material is deteriorated. It is assumed that this is because reducing the film thickness of the photosensitive layer covering the image carrier causes an abrupt change in potential at the edge portion of the electrostatic latent image, and an electric field in a transfer electric field acting on in a direction toward the transfer material is readily disturbed. Also, when toner with excellent transfer efficiency is used to reduce an amount of toner remaining after the transferring step, the toner is more easily scattered with a disturbance of the electric field in the transfer electric field.

Accordingly, Japanese Unexamined Patent Publication JP-A 2000-75690 (2000) discloses an arrangement provided with means for reducing a potential difference between an image portion where toner is adhered and a non-image portion where toner is not adhered on the surface of the image carrier after the developing step and before the transferring step, so that even when an electrostatic latent image with a well-defined edge portion is formed on the photosensitive layer with a thinner film thickness, a transfer electric field that acts on a toner image at a transfer position is allowed to remain intact, whereby it is possible to obtain a satisfactory transferred image without causing the scattering of toner.

The arrangement disclosed in JP-A 2000-75690 supra describes attenuation of a potential at the non-image portion by 20% to 60% as the means to reduce the potential difference between the image portion and non-image portion on the image carrier before the transferring step. However, the thicknesses of the photosensitive layer and toner layer, and other parameters that regulate the transfer electric field, such as amounts of charge and dielectric constants of these layers, are not considered at all, which poses a problem that when a use environment or the like changes, the scattering of toner cannot be prevented in a reliable manner.

SUMMARY OF THE INVENTION

It is therefore an object of the invention to provide an image forming apparatus for adequately setting the thicknesses of the photosensitive layer and toner layer that exert influence upon the development of a transfer electric field, and parameters that regulate the transfer electric field, such as amounts of charge and dielectric constants of these layers, so that even when a use environment or the like changes, the transfer electric field that acts on a toner image at a transfer position is allowed to remain intact constantly, whereby the scattering of toner at the time of transfer can be prevented in a stable manner, and therefore, a transferred image with a satisfactory image quality can be obtained in a reliable manner.

The invention has the following arrangements as means to solve the problems.

The invention provides an image forming apparatus comprising:

an image carrier including a photosensitive layer, on the photosensitive layer an electrostatic latent image being formed through a photoconductive function, a toner layer being formed on a surface of the image carrier by causing electrostatic adhesion of toner particles to the electrostatic latent image; and transfer means for transferring the toner particles electrostatically adhering to the surface of the image carrier, to a surface of a recording medium with an electrostatic force by bringing the surface of the recording medium into contact with the surface of the image carrier through the toner layer and applying a transfer voltage from the transfer means to another surface of the recording medium, wherein parameters of equivalent air thicknesses topc ($\mu$m) and yt ($\mu$m) of the photosensitive layer and toner layer, respectively, an amount of charge per unit area qpm ($(mg/cm^2)^{-1}$) of the toner layer, the amount of charge per unit area being normalized based on an amount of charge per unit area ρopc in a non-image portion of the photosensitive layer, an amount of charge per unit area ρ'opc in the non-image portion of the photosensitive layer upon entrance into a transfer region, and a total amount of charge per unit area ρo of the toner layer satisfy the following Equation (1):

$$|(\rho'opc-\rho o)/(\rho opc-\rho o)|<1$$

where $$\rho o=qpm\{(-0.01\cdot topc+0.145)yt^2+(0.001\cdot topc+0.937)yt\}. \quad (1)$$

According to the invention, the dielectric constant and thicknesses topc and yt of the photosensitive layer and toner layer, respectively, the amount of charge per unit area in the non-image portion of the photosensitive layer ρopc, the amount of charge per unit area of the toner layer qpm, the total amount of charge per unit area ρo of the toner layer, and the amount of charge per unit area ρ'opc in the non-image portion of the photosensitive layer are set upon entrance into the transfer region so as to satisfy the relation expressed by Equation (1). Hence, all the parameters that regulate an electric field developed in the transfer region are set so as not to increase an amount of variance of transfer electric field, there by making it possible to prevent the scattering of toner at the time of transfer in a stable manner.

In the invention it is preferable that the parameters satisfy the following equation:

$$|(\rho'opc-\rho o)/(\rho opc-\rho o)|<1/3.$$

According to the invention, variance of electric field in the transfer region by the transfer electric field is controlled to stay below 1/3. Hence, the scattering of toner of the toner layer over the non-image portion of the photosensitive layer is further suppressed, and deterioration of an image quality is further reduced. In other words, by limiting the variance of electric field to stay below ⅓, based on the fact that the psychological recognition level of visual stimulus by the human sense of sight and the intensity of the visual stimulus are in a logarithmically functional relation, the user senses that the scattering of the toner becomes half.

In the invention it is preferable that in Equation (1):

$$\rho'opc \approx \rho o.$$

According to the invention, an electric field distribution is smoothed on the surface of the image carrier positioned at the transfer region. Hence, an electric field developed in a direction along the surface of the image carrier is controlled, and therefore, it is possible to prevent the scattering of the toner particles electrostatically adhering to the surface of the image carrier.

In the invention it is preferable that a positive value is given to a quotient when variance of electric field dE expressed as the following Equation (2) is divided by ρopc:

$$dE=(\rho'opc-\rho o)\ (-0.0248\cdot yt+1.94)qpm\cdot topc \qquad (2).$$

According to the invention, because the variance of electric field dE is given with a positive value, an electric field heading inward to the center of the toner layer in a direction along the surface of the image carrier is formed in the transfer region. Hence, no static force heading outward from the toner layer acts on the toner particles electrostatically adhering to the surface of the image carrier in the transfer region, and therefore, the toner particles are not scattered over the non-image portion.

In the invention it is preferable that the image forming apparatus further comprises charge providing means for providing charges to lessen variance of transfer electric field in the transfer region to the surface of the image carrier after the electrostatic latent image is developed into a visible image and before the surface reaches the transfer region.

According to the invention, all the parameters that regulate the electric field developed in the transfer region are set so as not to increase an amount of variance of transfer electric field, plus charges that lessen the variance of electrostatic field are provided to the surface of the image carrier before the transfer is effected. Hence, the electric field distribution is smoothed further on the surface of the image carrier positioned at the transfer region, and the electric field developed in the direction along the surface of the image carrier is better controlled, thereby making it possible to prevent the scattering of the toner particles electrostatically adhering to the surface of the image carrier in a more stable manner.

In the invention it is preferable that the charge providing means is means for providing charges of a polarity the same as a polarity of charge of the toner or means for providing charges of a polarity opposite to a polarity of charge of the photosensitive layer on the image carrier.

According to the invention, charges are provided intensively to the toner that forms a valley of the electric field distribution in the transfer region, or the charges collected in the non-image portion that forms a peak of the electric field distribution are neutralized. In either case, the electric field distribution can be smoothed, thereby making it possible to prevent the scattering of toner by lessening variance of electric field.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
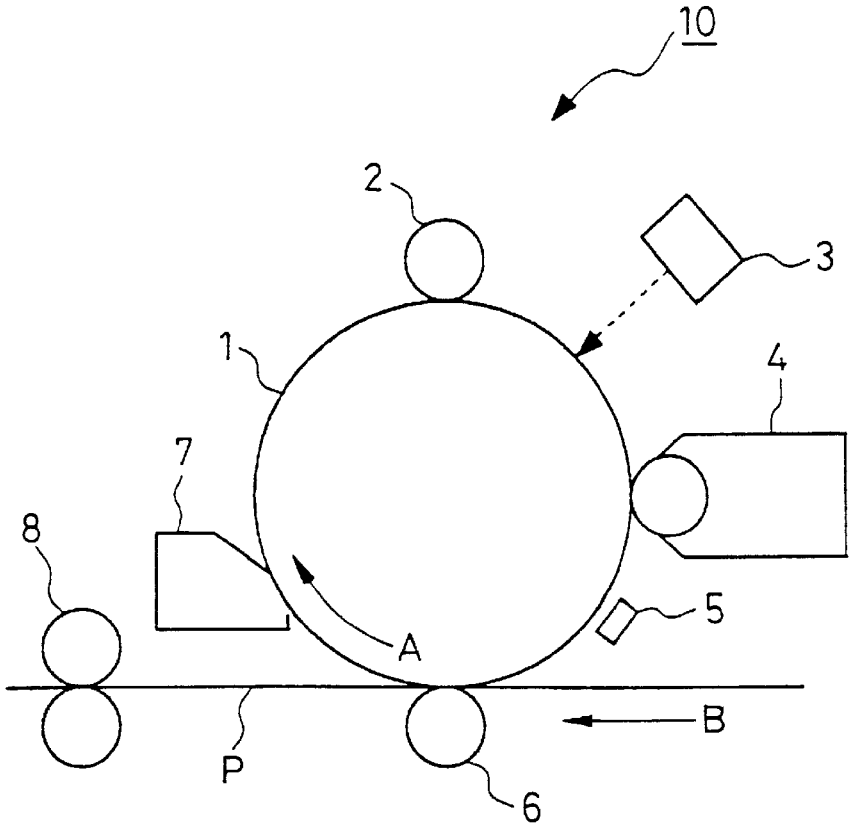
FIG. 1 is a view showing an arrangement of a processing section in an image forming apparatus in accordance with one embodiment of the invention.

Now referring to the drawings, preferred embodiments of the invention are described below.

FIG. 1 is a view showing an arrangement of a processing section in an image forming apparatus according to one embodiment of the invention. The processing section 10 in the image forming apparatus for performing electrophotographic image forming processing includes a photosensitive drum 1 allowed to rotate in a rotation direction A, which is surrounded by a charger 2, an exposure unit 3, a developing unit 4, an erasing charger 5, a transfer device 6, and a cleaner 7 placed in this order from upstream to downstream along the rotation direction A, and a pair of fusing rollers 8 placed downstream from an opposing position of the photosensitive drum 1 and transfer device 6 in a transportation direction B of a sheet of paper P (hereinafter, referred to as the sheet P) used as a recording medium of the invention.

Figure 2:
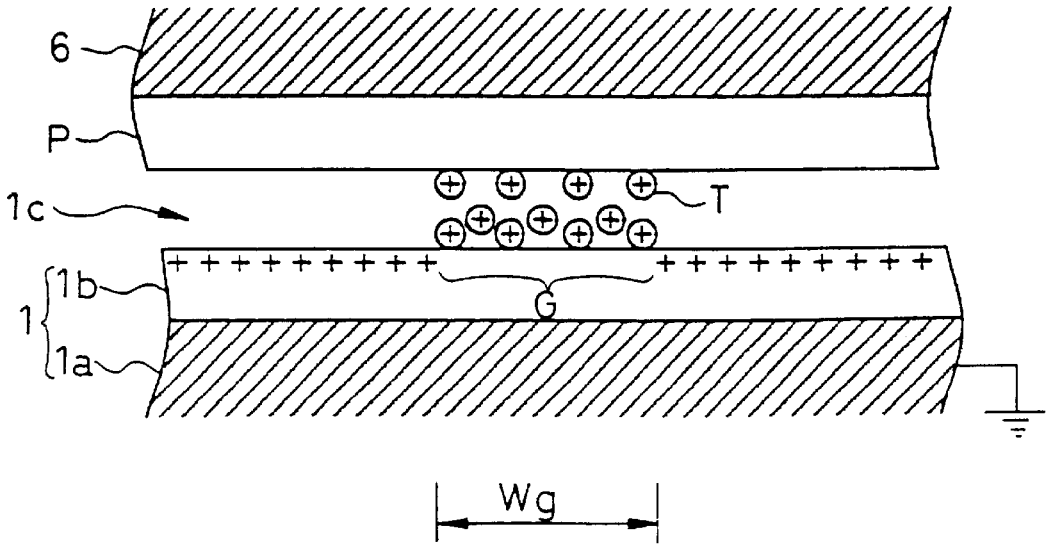
FIG. 2 is an enlarged view showing a state of a transfer region in the processing section.

The photosensitive drum 1 is an image carrier of the invention, and composed of a cylindrical conductive substrate 1*a* made of aluminum or the like and a photosensitive layer 1*b*covering the surface of the substrate 1*a* for inducing a photoconductive function (see FIG. 2). The charger 2 is composed of a brush or a roller, and brought into contact with the surface of the photosensitive drum 1 at its tip or outer surface to provide charges of a single polarity evenly on the surface of the photosensitive drum 1. The exposure unit 3 irradiates light of an image based on image data to the surface of the photosensitive drum 1 after it is charged by the charger 2. The photosensitive layer on the surface of the photosensitive drum 1 induces a photoconductive function at a portion irradiated by the light of the image. As a result, an electrostatic latent image is formed on the surface of the photosensitive drum 1. The developing unit 4 contains toner charged to a predetermined polarity in its interior, and develops the electrostatic latent image into a visible toner image by supplying the toner on the surface of the photosensitive drum 1. Consequently, a toner layer 1*c* is formed on the surface of the photosensitive drum 1.

The erasing charger 5 is a charge providing means of the invention, and provides charges of the polarity the same as the polarity of charge of the toner, or charges of a polarity opposite to the polarity of the charge of the photosensitive layer 1*b* on the photosensitive drum 1 to the surface of the photosensitive drum 1 before the transferring step by means of corona discharge. However, the erasing charger 5 is not essential. The transfer device 6 is applied with a predetermined transfer voltage from an unillustrated power source device. The transfer device 6 composed of a roller, a brush, a film or the like is transferring means of a contact transfer method that nips the sheet P transported along the transportation direction B and presses the sheet P against the surface of the photosensitive drum 1 at a predetermined pressing pressure in association with a rotation of the photosensitive drum 1 in the rotation direction A. The cleaner 7 removes the toner or the like remaining on the surface of the photosensitive drum 1 after the transferring step. The pair of fusing rollers 8 heat and apply a pressure on the sheet P having undergone the transferring step, so that the toner image transferred onto the sheet P is fused and fixed on the surface of the sheet P steadfastly.

The transfer device 6 nips the sheet P, and presses the sheet P against the surface of the photosensitive drum 1 at a contact portion (hereinafter, referred to the nip portion) with a predetermined width in the transportation direction B of the sheet P. The toner image carried on the surface of the photosensitive drum 1 is transferred onto the surface of the sheet P at the nip portion. In other words, the nip portion is a transfer region where a transfer electric field is developed by a transfer voltage applied from the transfer device 6.

In the processing section 10 arranged in the above manner, when toner T (assume that it is charged to the positive (+) polarity) forming the toner image carried on the surface of the photosensitive drum 1 comes to oppose the sheet P as the photosensitive drum 1 rotates in the rotation direction A, the toner T migrates from the surface of the photosensitive drum 1 to the surface of the sheet P by a transfer voltage E of the negative (−) polarity applied to the transfer device 6. As a result, a non-fused toner image is formed on the surface of the sheet P.

FIG. 2 is an enlarged view showing a state of the transfer region in the processing section 10. On the photosensitive layer 1*b* formed on the surface of the photosensitive drum 1, the positive-polarity charges provided from the charger 2 by the photoconductive function are grounded through the conductive substrate 1*a* at an image portion G with an image width Wg where the light of an image is irradiated from the exposure unit 3, and the positive-polarity toner T supplied from the developing unit 4 electrostatically adheres to the surface of that portion, whereby the toner layer 1*c* is formed thereon. The sheet P is pressed against the toner layer 1*c* by the transfer device 6 at the transfer region, and when a negative-polarity transfer voltage is applied to the sheet P from the transfer device 6, the toner T on the surface of the photosensitive layer 1*b* is transferred onto the sheet P.

Here, in order to form a sharp image on the sheet P, it is necessary that the toner T forming the image portion G migrates in a direction that intersects at right angles with the surface of the photosensitive layer 1*b* within the toner layer 1*c,* so that all of the toner T is transferred onto the surface of the sheet P within a region opposing the image portion G on the surface of the photosensitive layer 1*b*. However, an electric field is developed across the photosensitive layer 1*b* and sheet P with the toner layer 1*c* in between at the transfer region, and the toner T positioned within the toner layer 1*c* is susceptible to the electric field when it migrates to the surface of the sheet P. Thus, the toner T scatters over the surface of the sheet P at a region other than the region opposing the image portion G, which poses a problem that an image quality on the sheet P deteriorates. Hence, in order to obtain a satisfactory image quality on the sheet P, it is necessary to control an electric field developed in the transfer region, and more specifically, it is necessary to control the dielectric constant, thickness, and an amount of charge of each of the photosensitive layer 1*b* and toner layer 1*c*.

Figure 3:
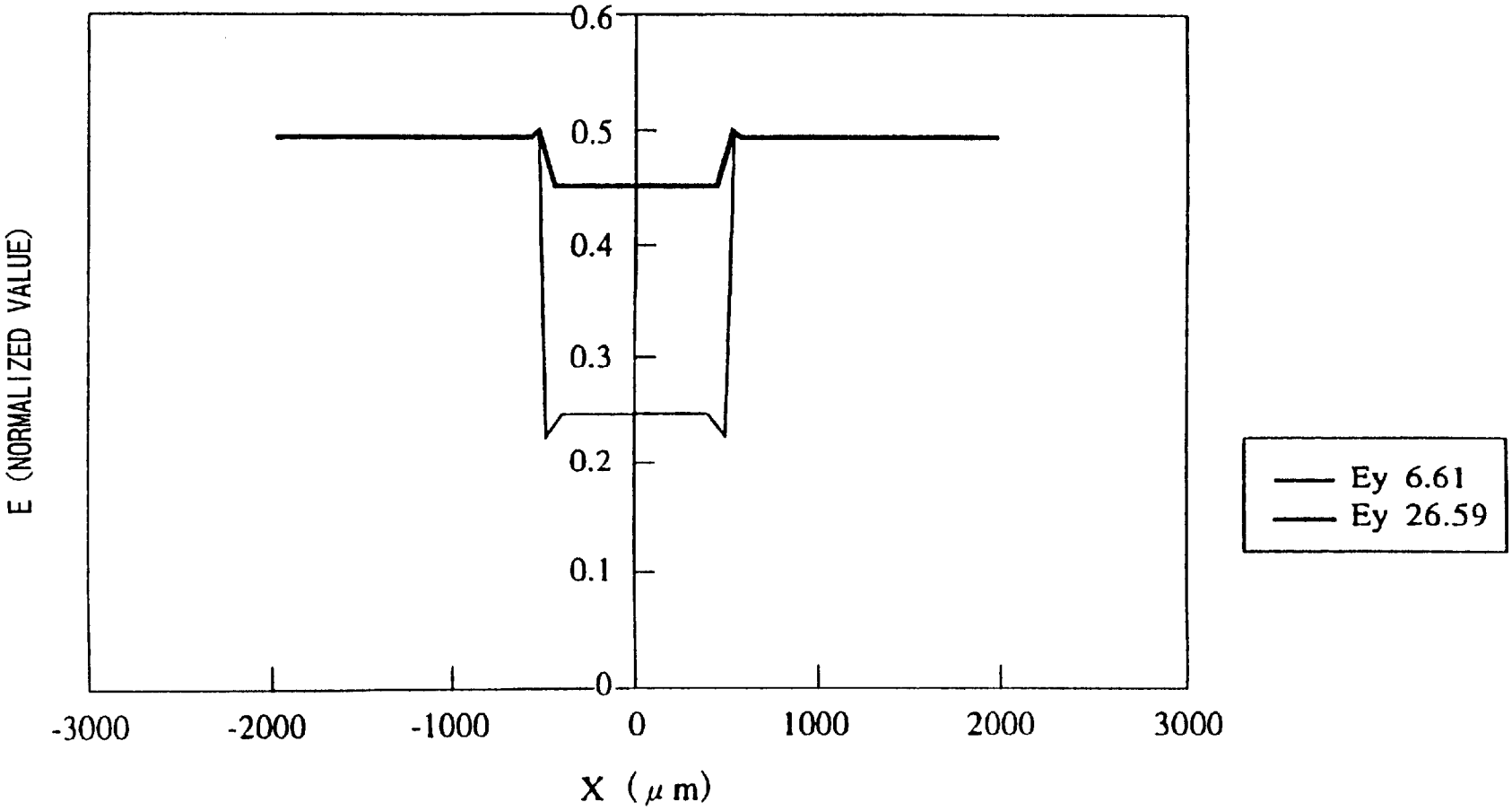
FIG. 3 is a view showing distribution states of a longitudinal electric field that acts on a toner layer at a position in the vicinity of a photosensitive layer, and a longitudinal electric field that acts on the toner layer at a position in the vicinity of a sheet of paper when the invention is not adapted.
Figure 4:
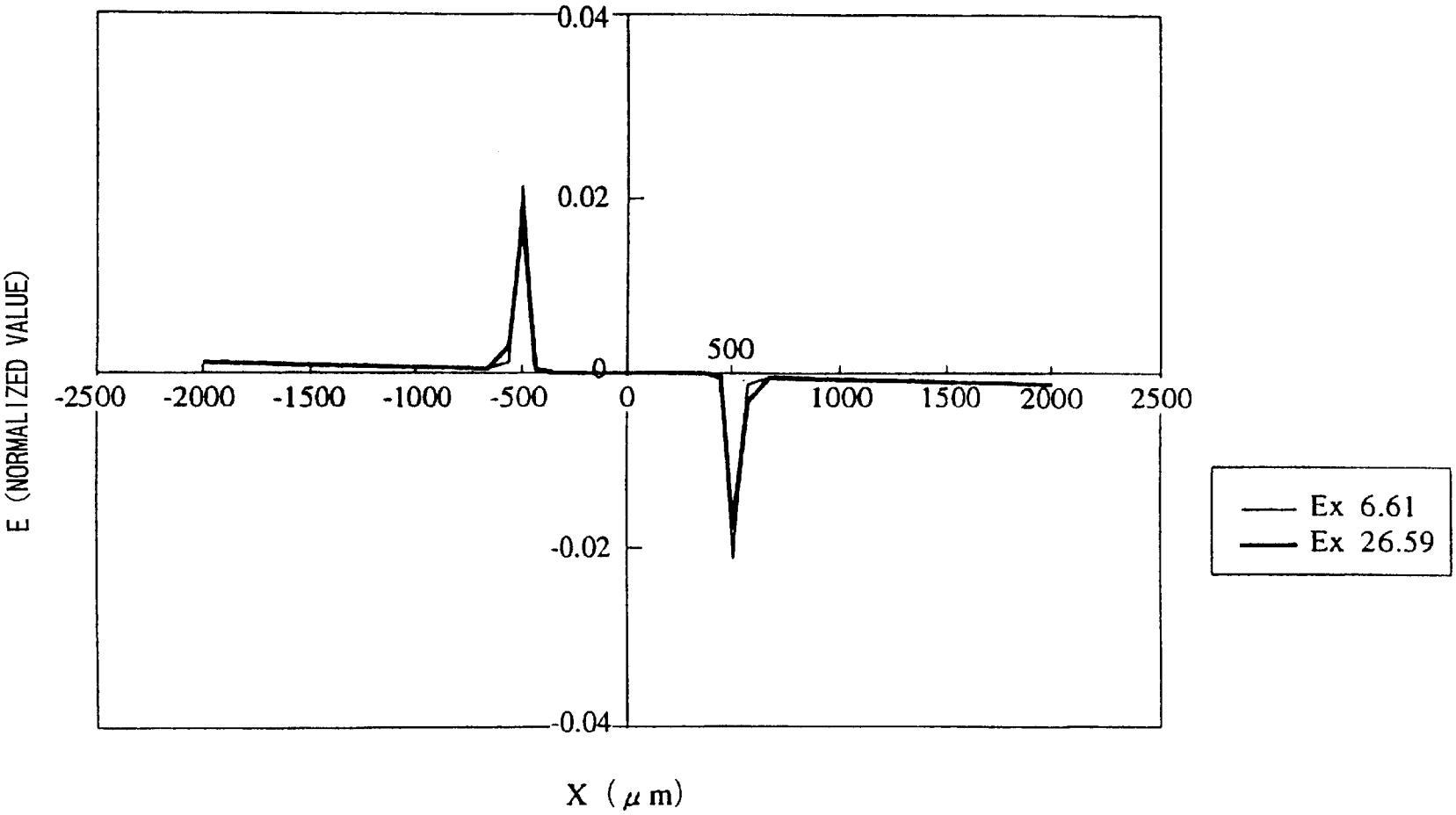
FIG. 4 is a view showing distribution states of a lateral electric field that acts on the toner layer at a position in the vicinity of the photosensitive layer, and a lateral electric field that acts on the toner layer at a position in the vicinity of a sheet of paper when the invention is not adapted.

More concretely, when the image width Wg is 1000 $\mu$m, an equivalent air thickness topc of the photosensitive layer 1*b* is 6.6 $\mu$m, and an equivalent air thickness yt of the toner layer 1*c* is 20 $\mu$m, then the electric field (longitudinal electric field) Ey6.61 in a direction that intersects at the right angles with the surface of the photosensitive layer 1*b* that acts on the toner layer 1*c* at a position in the vicinity of the photosensitive layer 1*b* (a position with a distance of 6.61 $\mu$m from the interface of the substrate 1*a* and photosensitive layer 1*b*), and a longitudinal electric field Ey26.59 that acts on the toner layer 1*c* at a position in the vicinity of the sheet P (a position with a distance of 26.59 $\mu$m from the interface of the substrate 1*a* and photosensitive layer 1*b*) have distribution states as shown in FIG. 3, respectively, wherein the dielectric constants of the sheet P, photosensitive layer 1*b* and toner layer 1*c* are about 2.3, about 3, and about 2 to 3, respectively. Accordingly the apparent dielectric constant of the toner layer 1*c* is about 1.1. The air equivalent thickness of the photosensitive layer 1*b* topc is obtained by dividing the actual thickness of the photosensitive layer 1*b* by the dielectric constant of the photosensitive layer 1*b*. The air equivalent thickness yt of the toner layer 1*c* is obtained by dividing the actual thickness of the toner layer 1*c* by the apparent dielectric constant of the toner layer 1*c*. Also, an electrical field (lateral electric field) Ex6.61 in a direction along the surface of the photosensitive layer 1*b* that acts on the toner layer 1*c* at a position in the vicinity of the photosensitive layer 1*b*, and a lateral electric field Ex26.59 that acts on the toner layer 1*c* at a position in the vicinity of the sheet P under the same condition have distribution states as shown in FIG. 4, respectively. In FIGS. 3 and 4, a value representing the electric field E is a normalized value on a base of "1" given as a potential per unit area in a non-image portion (a portion where no light of image was irradiated and charged electrons are remaining) in the photosensitive layer 1*b* after the development. Also, in FIGS. 3 and 4, a position X in the width direction of the image width Wg has an origin point at the center of the image width Wg in the width direction.

As is shown in FIGS. 3 and 4, when a potential of the photosensitive layer 1*b* varies abruptly at the edge portion of the image portion G, variance (a potential difference between the non-image portion and the edge of the image portion) of the electric field at this portion increases, which makes it impossible to control the migration direction of the toner T to stay at an adequate direction (a direction that intersects at right angles with the surface of the photosensitive layer 1*b*). Hence, in order to control the scattering of toner and thereby to prevent deterioration of the image quality, it is necessary to adequately control parameters that exert influence upon the development of a transfer electric field so as to lessen variance of electric field developed in an area covering the image portion G in the transfer region. In the invention, therefore, each parameter that exerts influence upon the development of the transfer electric field is set in such a manner so as to lessen variance of transfer electric field.

Figure 5:
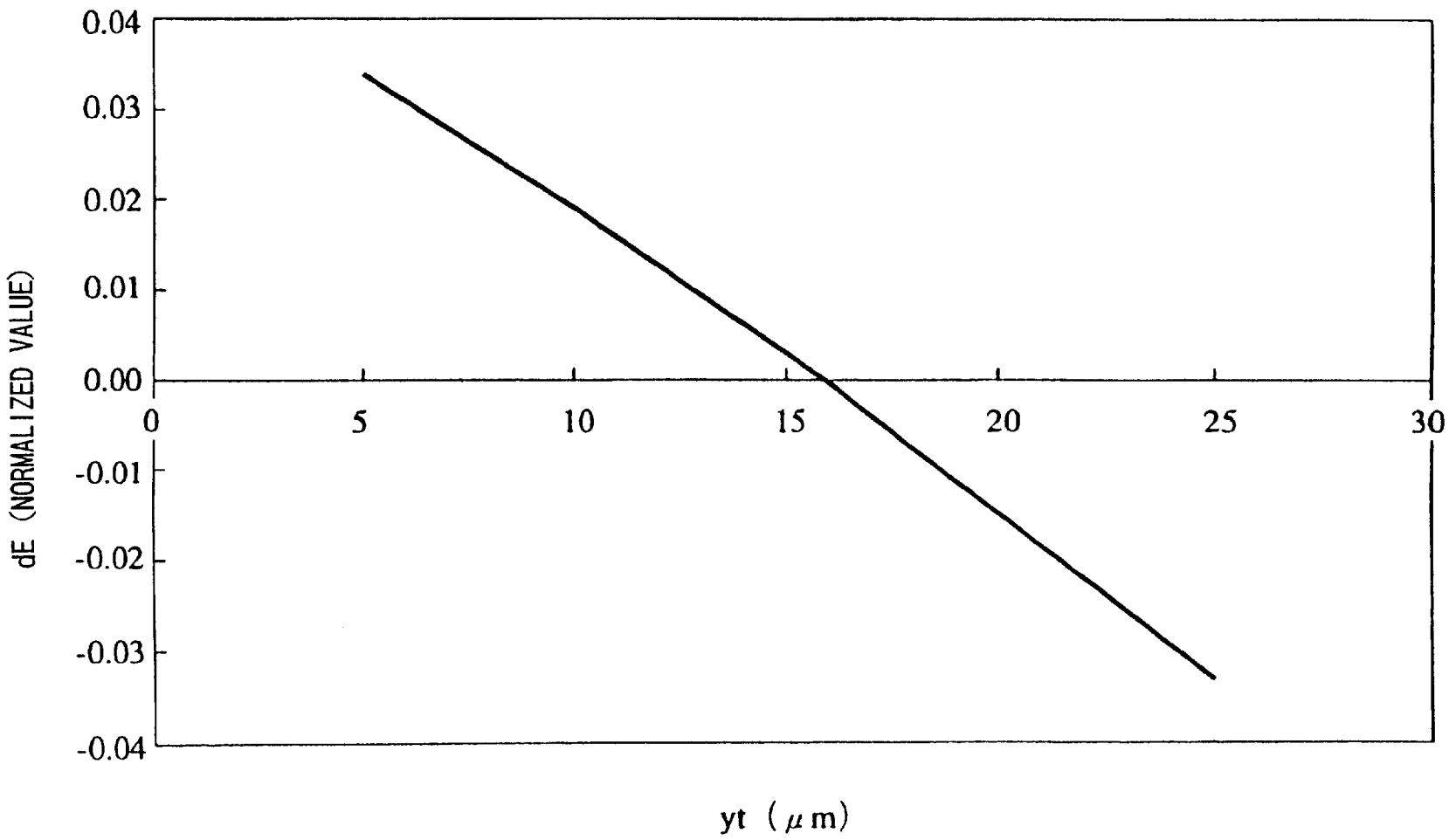
FIG. 5 is a view showing a relation of thickness of the toner layer versus variance of electric field.
Figure 6:
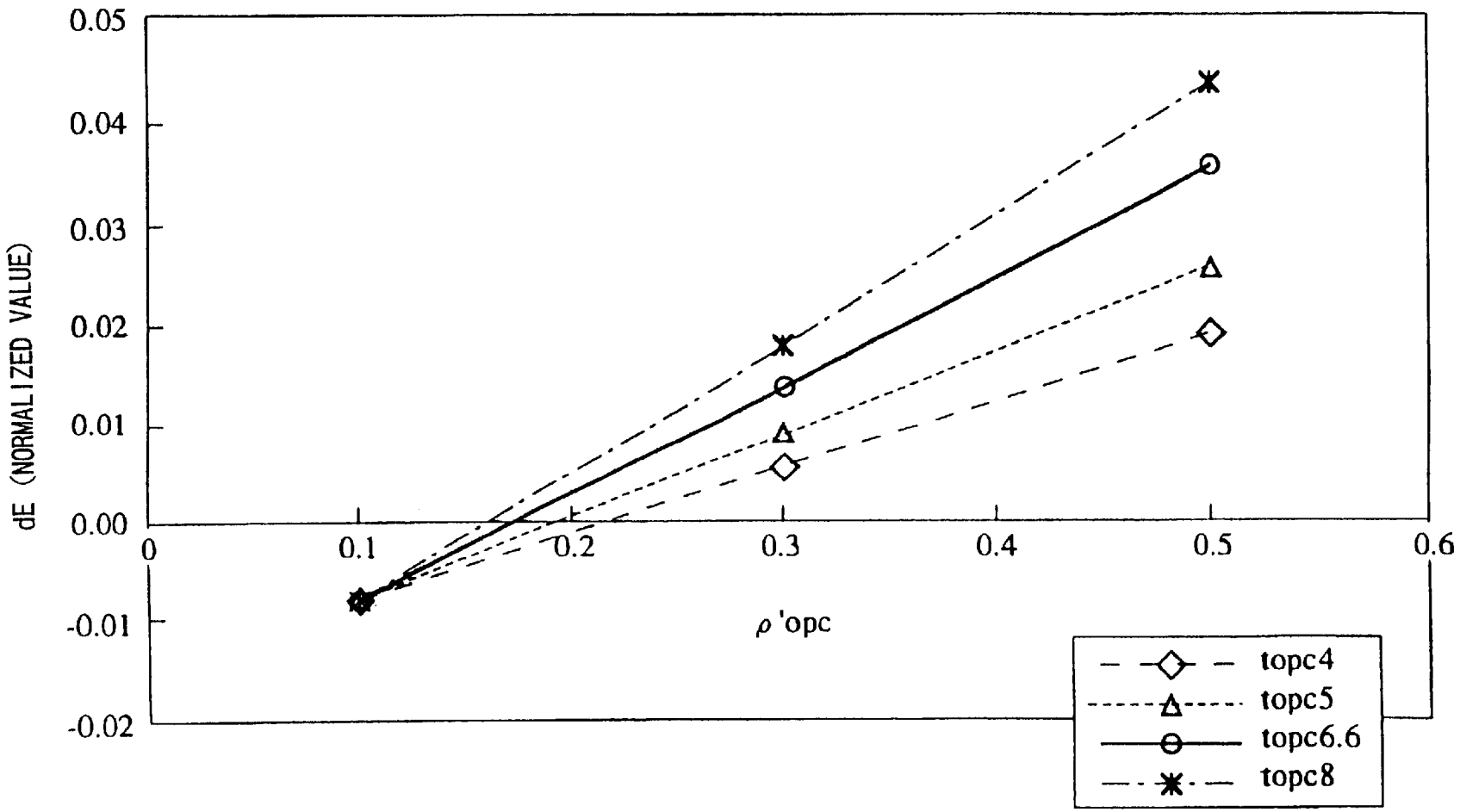
FIG. 6 is a view showing a relation of an amount of charge of the photosensitive layer versus variance of electric field when a thickness of the photosensitive layer is varied.

FIG. 5 is a view showing a relation of the thickness yt of the toner layer 1*c* versus variance of electric field dE when the image width Wg is 1000 $\mu$m, the equivalent air thickness topc of the photosensitive layer 1*b* is 6.6 $\mu$m, and an amount of charge per unit area ρ'opc of the photosensitive layer 1*b* is 0.35 after normalizing the amount of charge of the photosensitive layer 1*b* immediately before entering into the transfer region, with the amount of charge per unit area ρopc in the non-image portion of the photosensitive drum after development. In the embodiment the surface potential of the photosensitive drum 1 after development is 600 V, the surface potential of the photosensitive drum 1 immediately before entering into the transfer region is 200 V. Also, FIG. 6 is a view showing a relation of an amount of charge ρ'opc of the photosensitive layer 1*b* versus variance of electric field dE when the thickness topc of the photosensitive layer 1*b* is varied, given that the image width Wg is 1000 $\mu$m, the thickness yt of the toner layer 1*c* is 10 $\mu$m, and an amount of charge per unit area qpm of the toner layer 1*c* is 0.01. In FIGS. 5 and 6, a value representing variance of electric field dE is a normalized value on a base of "1" given as an electric field per unit area in the non-image portion of the photosensitive layer 1*b* after the development.

As shown in FIGS. 5 and 6, variance of electric field dE in the transfer region varies with the thickness yt of the toner layer 1*c* and an amount of charge ρ'opc of the photosensitive layer 1*b* in the transfer region. Hence, it is necessary to set the thickness yt of the toner layer 1*c* and an amount of charge ρ'opc of the photosensitive layer 1*b* in such a manner that variance of electric field dE takes a value "0".

As is obvious from FIG. 6, as to the relation of an amount of charge ρ'opc of the photosensitive layer 1*b* upon entrance into the transfer region versus variance of electric field dE, when the thickness topc of the photosensitive layer 1*b* varies, only a gradient of the line representing the relation is changed, and when an amount of charge ρ'opc of the photosensitive layer 1*b* is reduced approximately as small as 0.1, the lines are converged to substantially one point. Hence, given K as a gradient, then the relation of variance of electric field dE versus an amount of charge ρ'opc of the photosensitive layer 1*b* is given by:

$$dE=K\cdot\rho'opc-0.1\cdot K-0.008.$$

Figure 7:
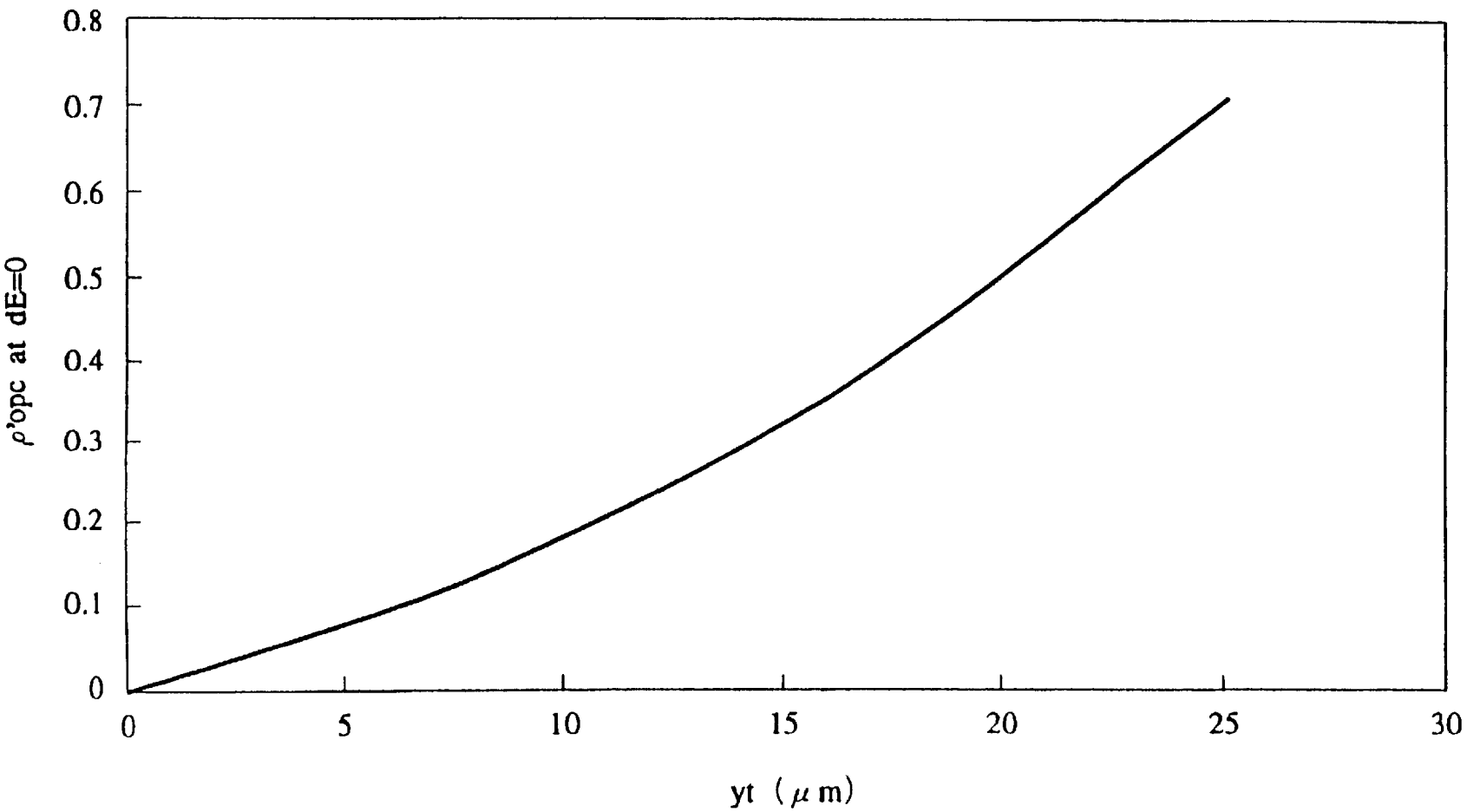
FIG. 7 is a view showing a relation of an amount of charge of the photosensitive layer versus the thickness of the toner layer such that variance of electric field becomes "0"

In other words, a relation of an amount of charge ρ'opc of the photosensitive layer 1*b* versus the thickness yt of the toner layer 1*c* such that variance of electric field dE becomes "0" is, for example, a state shown in FIG. 7 when the image width Wg is 1000 $\mu$m, the equivalent air thickness topc of the photosensitive layer is 6.6 $\mu$m, and an amount of charge per unit area qpm of the toner layer is 0.01, and given by:

$$\rho'opc=\alpha 1\cdot yt^2+\beta 1\cdot yt,$$

where $\alpha 1=0.0008$ and $\beta 1=0.009$.

Figure 8:
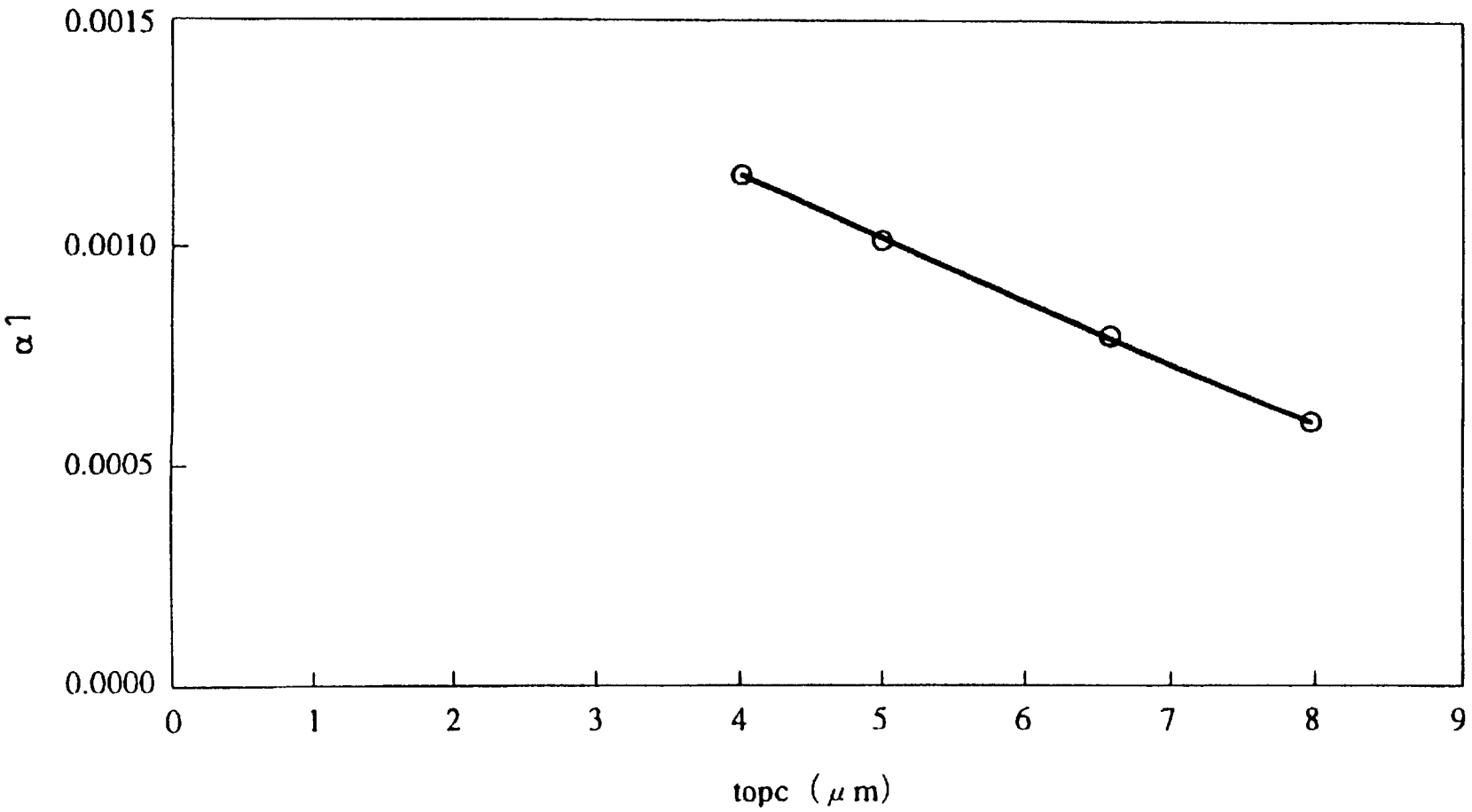
FIG. 8 is a view showing a change in values given to α1 that determines the relation of an amount of charge of the photosensitive layer versus the thickness of the toner layer such that variance of electric field becomes "0"
Figure 9:
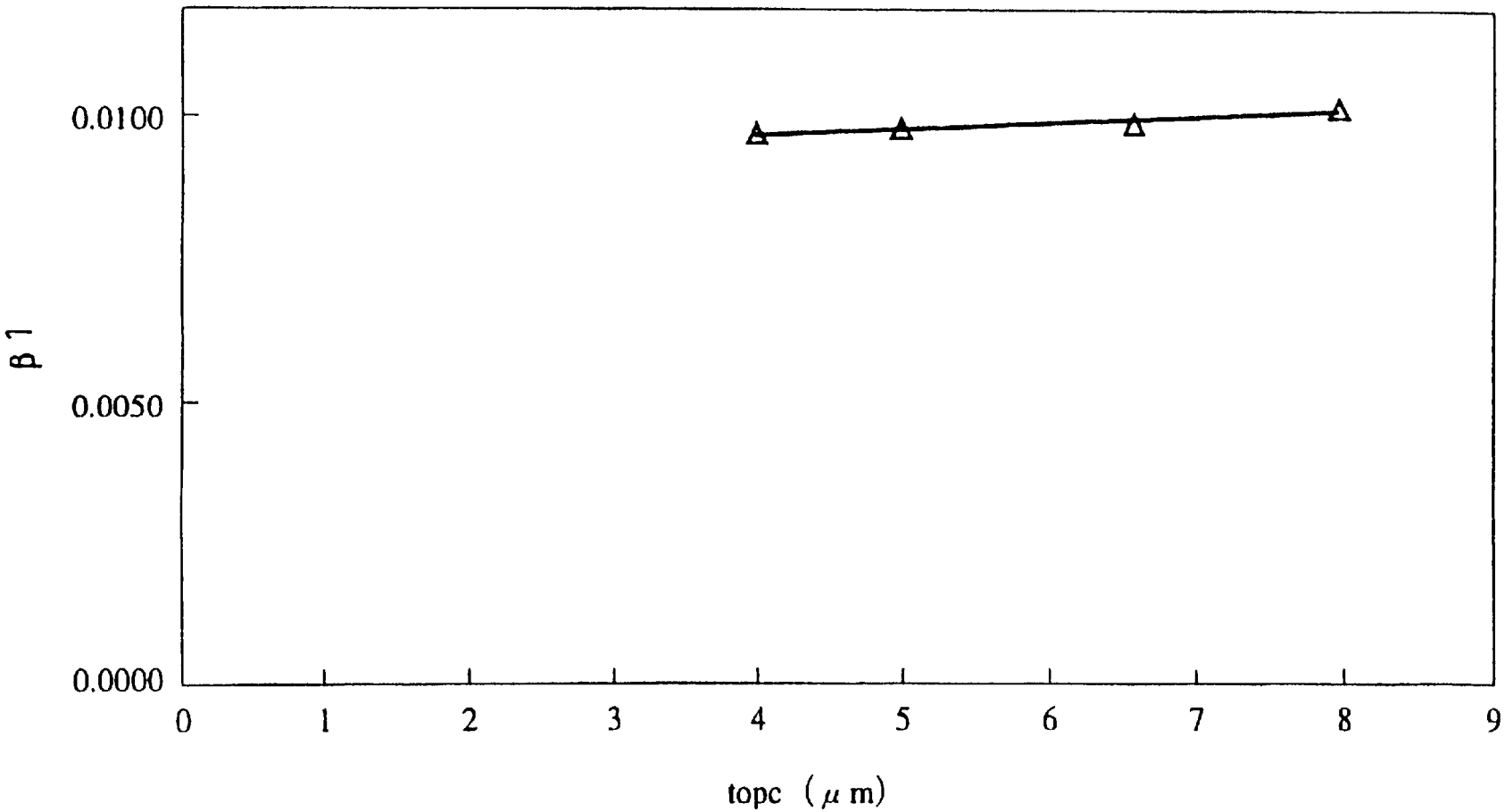
FIG. 9 is a view showing a change in values given to β1 that determines the relation of an amount of charge of the photosensitive layer versus the thickness of the toner layer such that variance of electric field becomes "0"

Here, as shown in FIGS. 8 and 9, values of $\alpha 1$ and $\beta 1$ vary with the thickness topc of the photosensitive layer 1*b*, and are determined as follows:

$$\alpha 1=-0.000136\cdot topc+0.00169$$

$$\beta 1=0.000118\cdot topc+0.0093.$$

Figure 10:
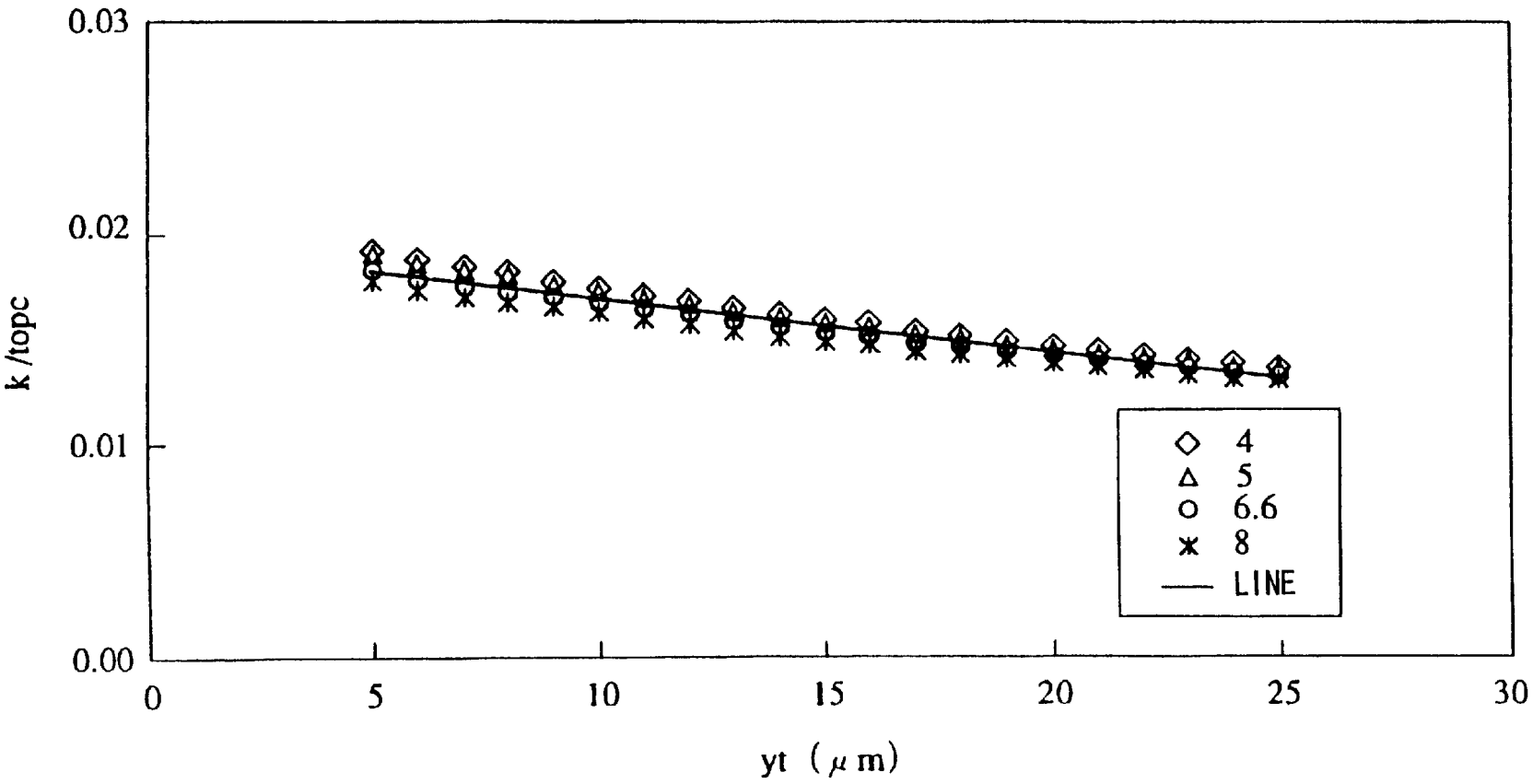
FIG. 10 is a view showing a relation of a nip width versus an amount of engagement in a transfer portion adapting a contact transfer method when a value representing a gradient of each line shown in FIG. 6 is normalized with the thickness of the photosensitive layer and an amount of charge per unit thickness of the toner layer.

From the relations as shown in FIGS. 8 through 10, a total amount of charge per unit area ρo of the toner layer 1*c*, which is the condition such that variance of electric field dE becomes "0", can be approximated as follows by using the equivalent air thicknesses topc ($\mu$m) and yt ($\mu$m) of the photosensitive layer and toner layer, respectively, and an amount of charge per unit area qpm of the toner layer ($(mg/cm^2)^{-1}$), normalized based on an amount of charge per unit area ρopc in the non-image portion of the photosensitive layer:

$$\rho o=qpm\{(-0.0136\cdot topc+0.169)yt^2+(0.00118\cdot topc+0.93)\ yt\}.$$

In the relation shown in FIG. 6, by normalizing a value representing the gradient K of each line with the thickness topc of the photosensitive layer 1*b*, the following equation is obtained:

$$K/(topc\cdot qpm)=-0.0248yt+1.94.$$

Figure 11:
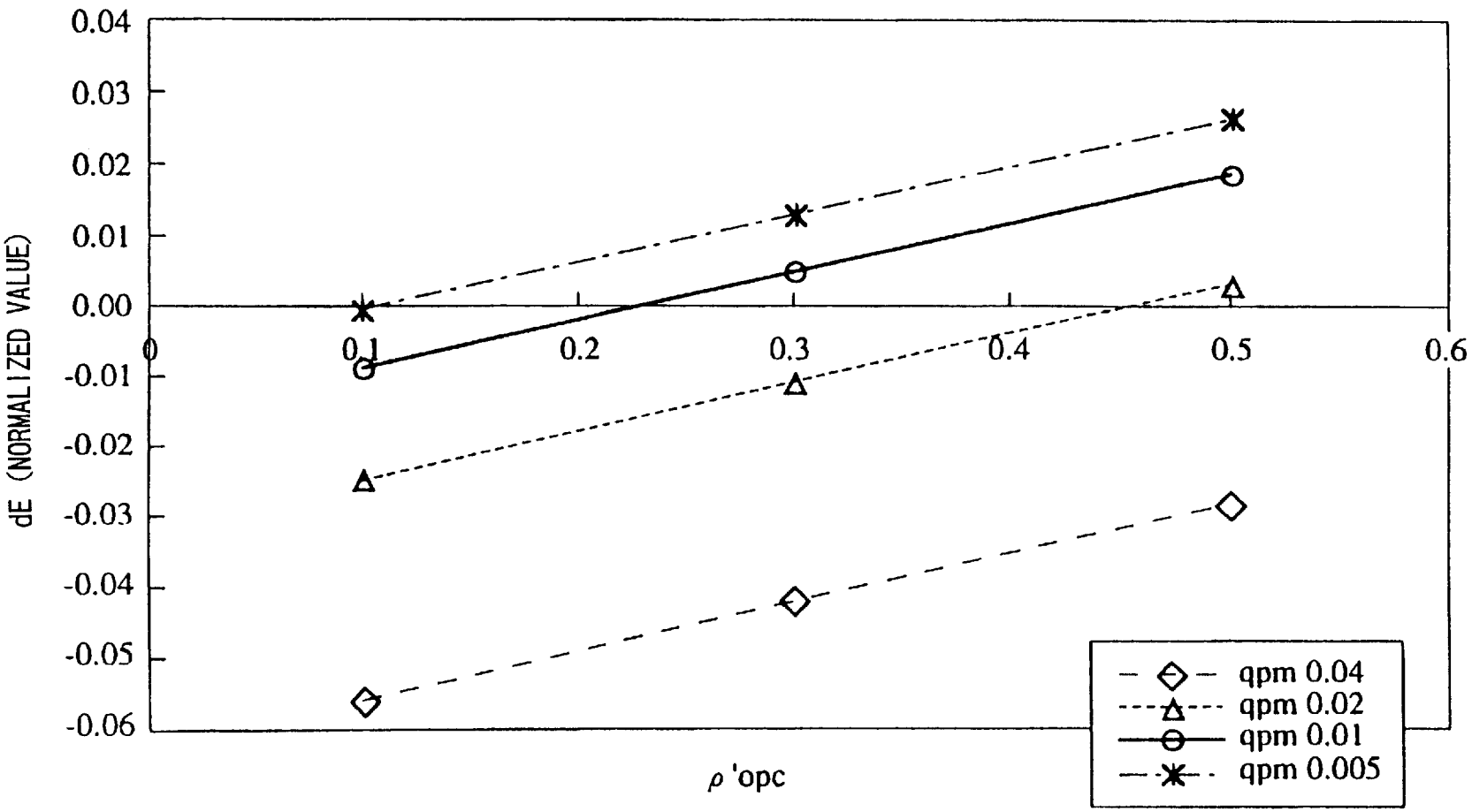
FIG. 11 is a view showing a relation of an amount of charge of the photosensitive layer versus variance of electric field when an amount of charge per unit thickness of the toner layer is varied.

On the other hand, as shown in FIG. 11, as to the relation of an amount of charge ρ'opc of the photosensitive layer 1*b* upon entrance into the transfer region versus variance of electric field dE, when an amount of charge per unit area qpm of the toner layer 1*c* varies, a gradient of the line remains the same and only an intercept varies. Hence, given K as a gradient, then the relation of variance of electric field dE versus an amount of charge ρ'opc of the photosensitive layer 1*b* is given by:

$$dE=K\cdot\rho'opc-0.1\cdot K-0.008-1.57\cdot qpm+0.0157.$$

Figure 12:
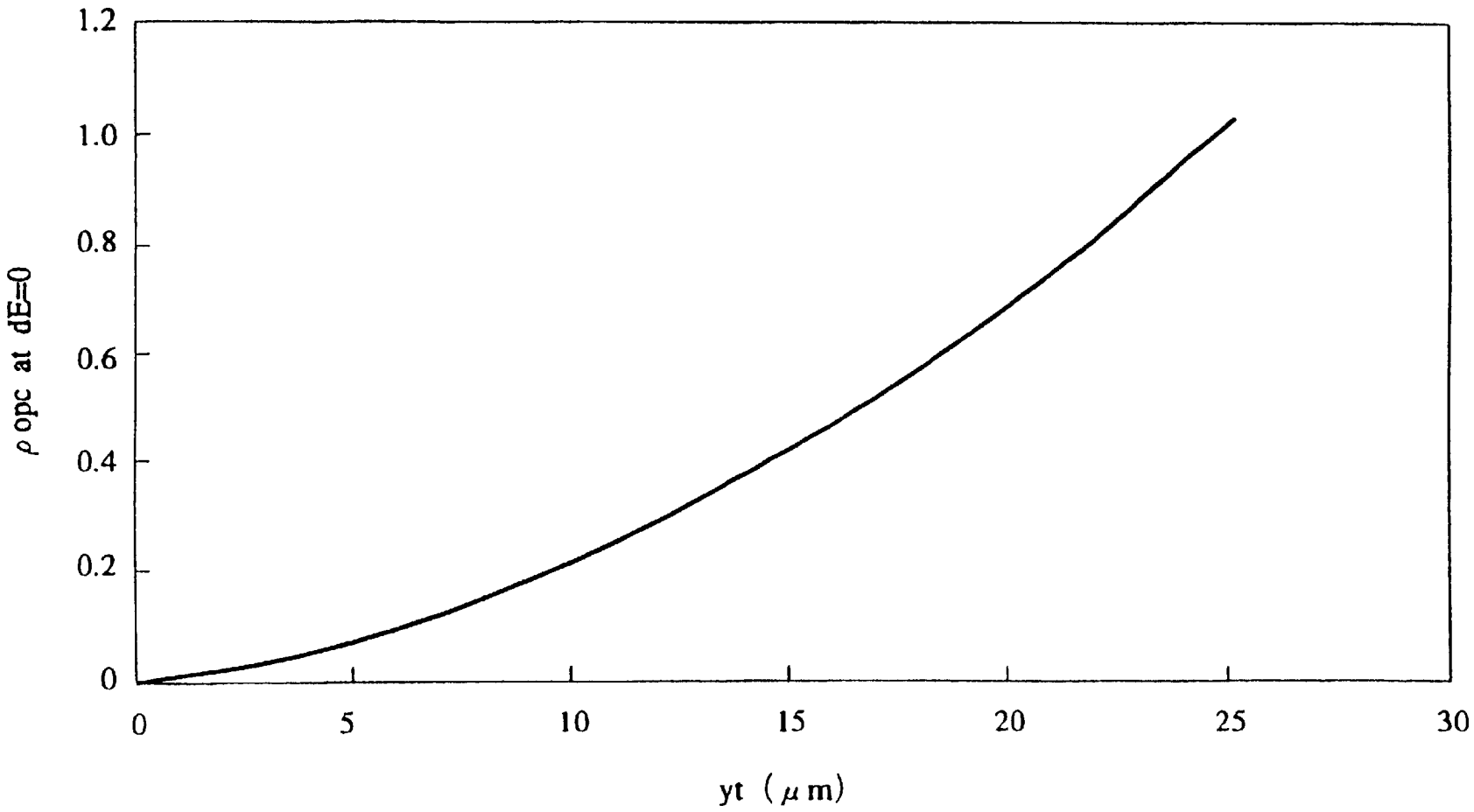
FIG. 12 is a view showing a relation of an amount of charge of the photosensitive layer versus the thickness of the toner layer such that variance of electric field becomes "0" when the invention is adapted.

Hence, the relation of a normalized amount of charge ρ'opc of the photosensitive layer 1*b* versus the thickness yt of the toner layer 1*c* such that variance of electric field dE becomes "0" is, for example, a state as shown in FIG. 12 when the image width Wg is 1000 $\mu$m, the equivalent air thickness topc of the photosensitive layer 1*b* is 6.6 $\mu$m, and an amount of charge per unit area qpm of the toner layer 1*c* is 0.01, and given by:

$$\rho'opc=\alpha 2\cdot yt^2+\beta 2\cdot yt,$$

wherein $\alpha 2=0.0012$ and $\beta 2=0.011$.

Figure 13:
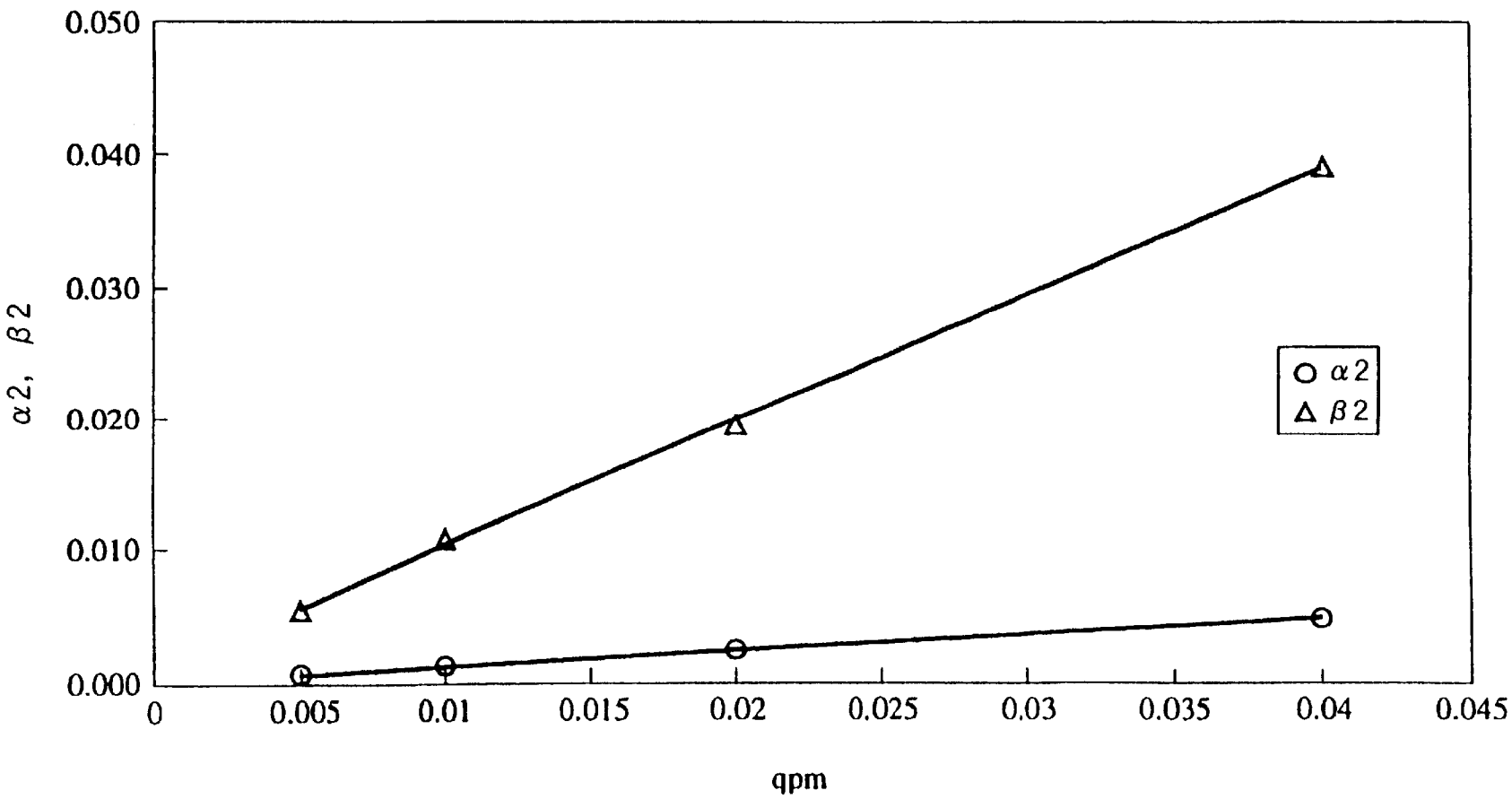
FIG. 13 is a view showing a change in values given to α2 and β2 that determine the relation of an amount of charge of the photosensitive layer versus the thickness of the toner layer such that variance of electric field becomes "0" when the invention is adapted.

Here, as shown in FIG. 13, values of $\alpha 2$ and $\beta 2$ vary with an amount of charge per unit area qpm of the toner layer 1*c*, and are determined as follows:

$$\alpha 2=0.122\ pqm$$

$$\beta 2=pqm.$$

The normalized amount of charge ρo of toner from which a variance of electric field dE of 0 is obtained, is represented by the thickness topc of the photosensitive drum and the amount of charge qpm as follows:

$$\rho o=qpm\{(-0.01\cdot topc+0.145)yt^2+(0.001\cdot topc+0.937)yt\}.$$

Figure 14:
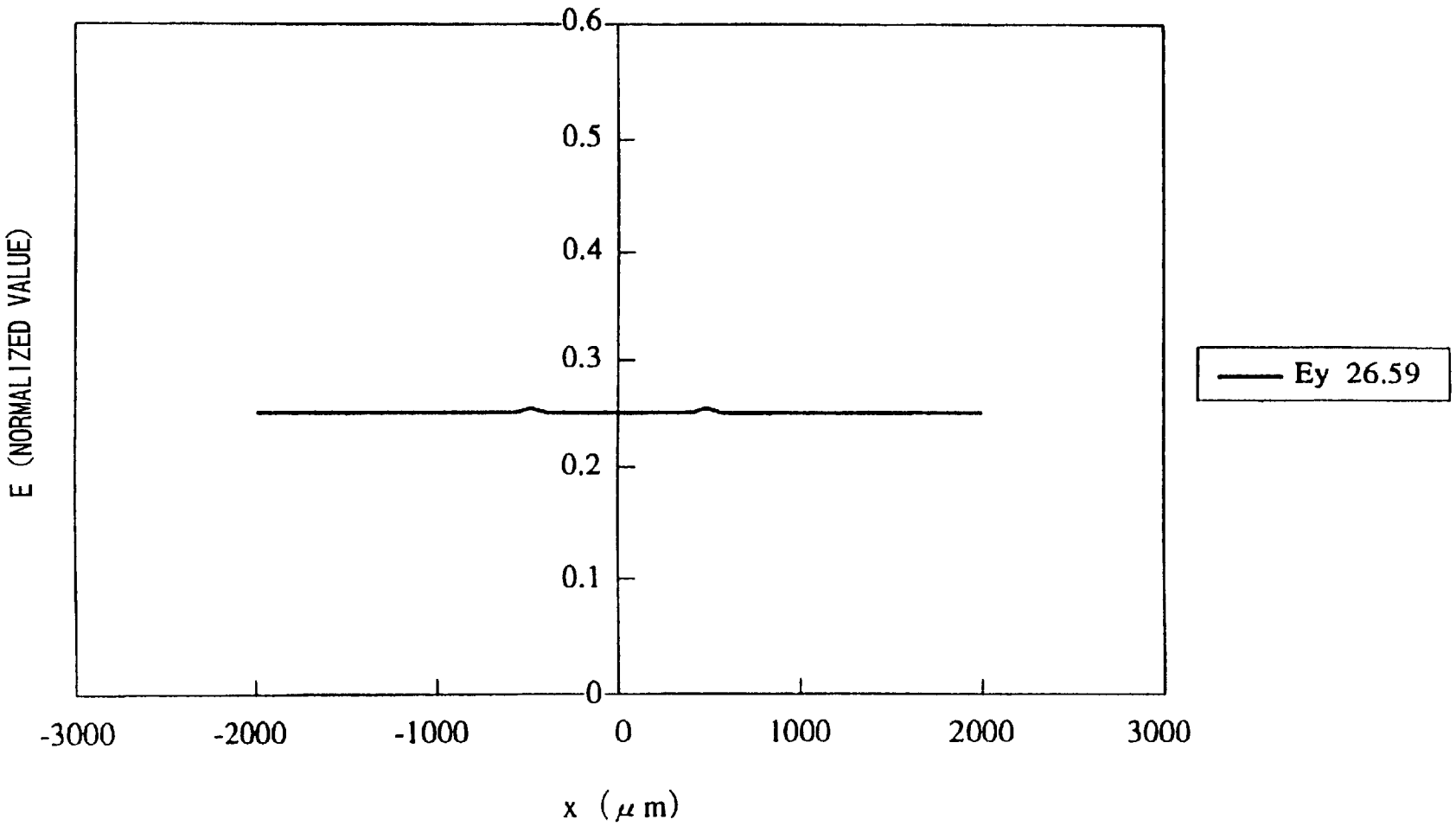
FIG. 14 is a view showing a distribution state of a lateral electric field that acts on the toner layer at a position in the vicinity of a sheet of paper when the invention is adapted.

As has been discussed, by setting each parameter that exerts influence upon the development of the transfer electric field in such a manner so as to lessen variance of transfer electric field, a longitudinal electric field Ey26.59 that acts on the toner layer 1*c* at a position in the vicinity of the sheet P (a position with a distance of 26.59 μm from the interface of the substrate 1*a* and photosensitive layer 1*b*) has a distribution state as shown in FIG. 14. Also, a lateral electric field Ex26.59 that acts on the toner layer 1*c* at a position in the vicinity of the sheet P under the same condition has a distribution state as shown in FIG. 15, wherein the thickness and dielectric constant of the sheet P are 100 μm and 2.3, respectively, the thickness and dielectric constant of the photosensitive layer 1*b* are 19.8 μm and 3, respectively, the thickness of the toner layer 1*c* and the apparent dielectric constant of the toner are 20 μm and 1, respectively, the exposure width is 1,000 μm, and the normalized amounts of charge qpm, ρ'opc and ρo are 0.01, 0.503 and 0.0503.

Figure 15:
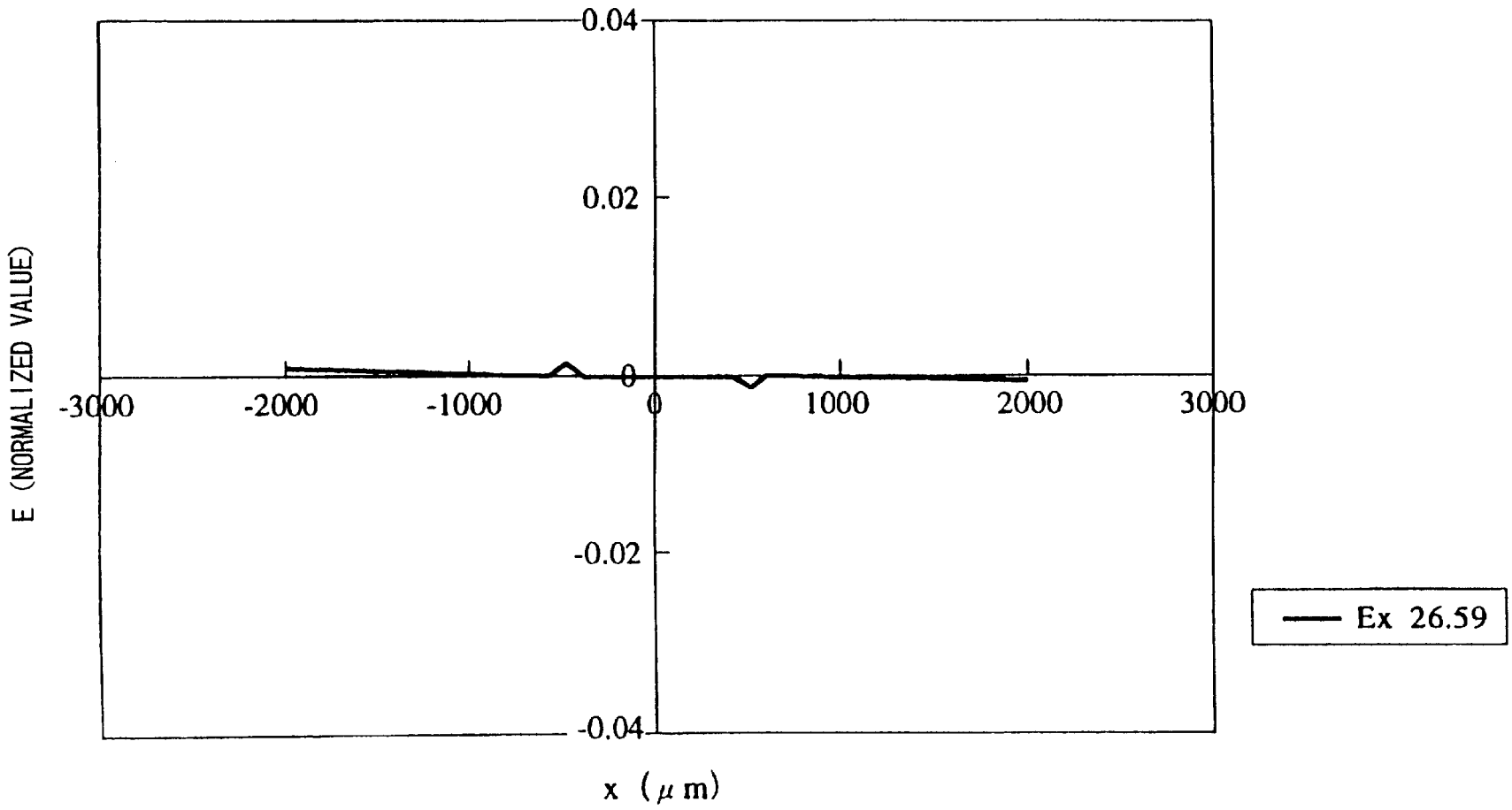
FIG. 15 is a view showing a distribution state of a longitudinal electric field that acts on the toner layer at a position in the vicinity of a sheet of paper when the invention is adapted.

As shown in FIGS. 14 and 15, by adapting the invention, it is possible to reduce variance of electric field in the transfer region markedly compared with the results shown in FIGS. 3 and 4. Consequently, the scattering of toner in the toner layer 1*c* over the photosensitive layer 1*b* on the photosensitive drum 1 can be prevented, thereby making it possible to control deterioration of an image quality in a reliable manner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image carrier including a photosensitive layer, on the photosensitive layer an electrostatic latent image being formed through a photoconductive function, a toner layer being formed on a surface of the image carrier by causing electrostatic adhesion of toner particles to the electrostatic latent image; and transfer means for transferring the toner particles electrostatically adhering to the surface of the image carrier, to a surface of a recording medium with an electrostatic force by bringing the surface of the recording medium into contact with the surface of the image carrier through the toner layer and applying a transfer voltage from the transfer means to another surface of the recording medium, wherein parameters of equivalent air thicknesses topc (μm) and yt (μm) of the photosensitive layer and toner layer, respectively, an amount of charge per unit area qpm ($(mg/cm^2)^{-1}$) of the toner layer, the amount of charge per unit area being normalized based on an amount of charge per unit area ρopc in a non-image portion of the photosensitive layer, an amount of charge per unit area ρ'opc in the non-image portion of the photosensitive layer upon entrance into a transfer region, and a total amount of charge per unit area ρo of the toner layer satisfy the following Equation (1):

$$|(\rho'opc-\rho o)/(\rho opc-\rho o)|<1$$

where $$\rho o=qpm\{(-0.01\cdot topc+0.145)yt^2+(0.001\cdot topc+0.937)yt\}. \quad (1)$$

2. The image forming apparatus of claim 1, wherein said parameters satisfy the following equation:

$$|(\rho'opc-\rho o)/(\rho opc-\rho o)|<1/3.$$

3. The image forming apparatus of claim 2, further comprising:

charge providing means for providing charges to lessen variance of transfer electric field in the transfer region to the surface of the image carrier after the electrostatic latent image is developed into a visible image and before the surface reaches the transfer region.

4. The image forming apparatus of claim 3, wherein the charge providing means is means for providing charges of a polarity the same as a polarity of charge of the toner.

5. The image forming apparatus of claim 3, wherein the charge providing means is means for providing charges of a polarity opposite to a polarity of charge of the photosensitive layer on the image carrier.

6. The image forming apparatus of claim 1, wherein in Equation (1):

$$\rho'opc\approx\rho o.$$

7. The image forming apparatus of claim 6, further comprising:

charge providing means for providing charges to lessen variance of transfer electric field in the transfer region to the surface of the image carrier after the electrostatic latent image is developed into a visible image and before the surface reaches the transfer region.

8. The image forming apparatus of claim 7, wherein the charge providing means is means for providing charges of a polarity the same as a polarity of charge of the toner.

9. The image forming apparatus of claim 7, wherein the charge providing means is means for providing charges of a polarity opposite to a polarity of charge of the photosensitive layer on the image carrier.

10. The image forming apparatus of claim 1, wherein a positive value is given to a quotient when variance of electric field dE expressed as the following Equation (2) is divided by ρopc:

$$dE=(\rho'opc-\rho o)\ (-0.0248\cdot yt+1.94)qpm\cdot topc \quad (2)$$

11. The image forming apparatus of claim 4, further comprising:

charge providing means for providing charges to lessen variance of transfer electric field in the transfer region to the surface of the image carrier after the electrostatic latent image is developed into a visible image and before the surface reaches the transfer region.

12. The image forming apparatus of claim 11, wherein the charge providing means is means for providing charges of a polarity the same as a polarity of charge of the toner.

13. The image forming apparatus of claim 11, wherein the charge providing means is means for providing charges of a polarity opposite to a polarity of charge of the photosensitive layer on the image carrier.

14. The image forming apparatus of claim 1, further comprising:

charge providing means for providing charges to lessen variance of transfer electric field in the transfer region to the surface of the image carrier after the electrostatic latent image is developed into a visible image and before the surface reaches the transfer region.

15. The image forming apparatus of claim 14, wherein the charge providing means is means for providing charges of a polarity the same as a polarity of charge of the toner.

16. The image forming apparatus of claim 14, wherein the charge providing means is means for providing charges of a polarity opposite to a polarity of charge of the photosensitive layer on the image carrier.

* * * * *